US006250370B1

(12) United States Patent
Tada et al.

(10) Patent No.: US 6,250,370 B1
(45) Date of Patent: Jun. 26, 2001

(54) METHOD FOR WATER-COOLING HOT METAL SLABS

(75) Inventors: Chikashi Tada, Tokyo; Yuji Miki, Chiba, both of (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/198,860

(22) Filed: Nov. 24, 1998

(30) Foreign Application Priority Data

May 28, 1998 (JP) ..... 10-147453
Aug. 31, 1998 (JP) ..... 10-246174

(51) Int. Cl.[7] ..... B22D 11/124
(52) U.S. Cl. ..... 164/486; 164/487
(58) Field of Search ..... 164/486, 485, 164/443, 444, 487

(56) References Cited

U.S. PATENT DOCUMENTS

| | | | | |
|---|---|---|---|---|
| 3,693,352 | * | 9/1972 | Hines et al. | 164/486 |
| 3,892,391 | | 7/1975 | Okuno | 266/2 A |
| 4,204,880 | | 5/1980 | Schwitzgobel | 134/32 |
| 4,901,785 | * | 2/1990 | Dykes et al. | 164/486 |
| 4,951,734 | * | 8/1990 | Hoffken et al. | 164/486 |
| 5,915,457 | * | 6/1999 | Pleschintschnigg | 164/486 |

FOREIGN PATENT DOCUMENTS

| | | | | |
|---|---|---|---|---|
| 23 49 189 | | 4/1975 | (DE) . | |
| 0 027 787 | | 4/1981 | (EP) . | |
| 55-147468 | * | 11/1980 | (JP) . | |
| 4-266416 | | 9/1992 | (JP) . | |
| 6-87054 | | 3/1994 | (JP) . | |
| 7-100609 | | 4/1995 | (JP) . | |
| 952419 | * | 8/1982 | (SU) | 164/486 |
| 952421 | * | 8/1982 | (SU) | 164/486 |

* cited by examiner

*Primary Examiner*—Tom Dunn
*Assistant Examiner*—I.-H. Lin
(74) *Attorney, Agent, or Firm*—Austin R. Miller

(57) ABSTRACT

Water-cooling slabs by dipping to yield steel sheets with a minimum of scabs and uneven gloss, with their larger faces upside and underside, by water injection at a flow rate of 10–150 L/m$^2$·min perpendicular or oblique to the underside of the slabs, with the position of water injection 30–500 mm away from the underside of the slabs.

7 Claims, 5 Drawing Sheets

METHOD FOR WATER-COOLING HOT METAL SLABS

BACKGROUND OF THE INVENTION

1. Field of the Invention

The present invention relates to a method for water-cooling metallic slabs and, more particularly, to a method for cooling steel slabs by dipping them in water while they are still at a high temperature, after continuous casting. The present invention relates also to an apparatus suitable for performing this method.

2. Description of the Related Art

It is common practice in steel production that refined molten steel of a desired composition is made into slabs by continuous casting or ingot making. Subsequently they are made into steel products of desired shape by hot rolling or cold rolling. Slabs are sometimes cooled in water while they are still hot after solidification. This cooling is intended to avoid transformation which would otherwise aggravate the surface and internal quality of steel products and also to avoid undesirable precipitation.

A problem that arises when continuously cast stainless steel slabs are allowed to cool spontaneously is that alloying elements (such as chromium) in the steel combines with carbon to form carbides which selectively precipitate at grain boundaries, thereby forming a chromium-deficient layer in the vicinity of the precipitates. The result of rolling such slabs containing an uneven composition, particularly in the case where hot rolling is followed by cold rolling, is development of surface defects such as irregular gloss.

In addition, continuously cast slabs are subject to cyclic surface irregularities (oscillation marks) due to vertical oscillation of the mold. Such surface irregularities have troughs in which nickel segregates. This leads to grain-like defects after rolling and pickling.

In order to address the above-mentioned problem, the present inventors had previously proposed a process for producing stainless steel slabs (Japanese Patent Laid-open No. 87054/1994) and a process for refining stainless steel slabs (Japanese Patent Laid-open No. 266416/1992). The former is characterized by cooling cast slabs continuously at a cooling rate higher than prescribed. The latter is characterized by cooling cast slabs continuously (with the surface temperature kept higher than 400° C.), performing shot blasting, heating to 1100° C. and above, and removing scale from slabs. The present inventors had also proposed an apparatus for cooling hot slabs in water (Japanese Patent Laid-open No. 100609/1995).

The processes and apparatus mentioned above, however, were found to cause surface defects (such as uneven gloss and scab) when applied to the production of stainless steel sheet from continuously cast stainless steel slabs by hot rolling and cold rolling.

SUMMARY OF THE INVENTION

The present invention was completed in order to address these problems which have never been anticipated in the conventional technology. Accordingly, it is an object of the present invention to provide a method for cooling slabs such that cooled slabs can be made, by cold rolling, into steel sheets having a minimum of partial gloss variation and scabs. It is another object of the present invention to provide a cooling water vessel suitable for such cooling.

DETAILED DESCRIPTION OF THE PREFERRED EMBODIMENTS

Figure 1:
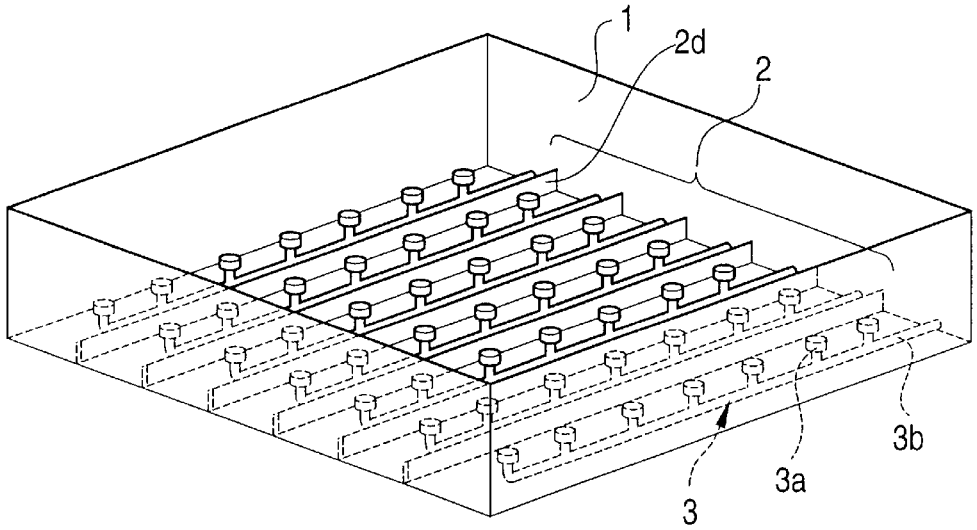
FIG. 1 is a schematic diagram showing the construction of the cooling water vessel pertaining to one example of the present invention.

To solve the above-mentioned problems, careful and detailed research was conducted on the cause of surface defects that partly occur on stainless steel thin sheets produced by hot rolling and cold rolling from slabs treated by either of the processes disclosed in Japanese Patent Laid-open Nos. 87054/1994 and 266416/1992 given above. The results of the research revealed that surface defects (such as partial gloss variation and scabs) occur more or less regardless of whether the process involves either (1) water cooling alone or (2) water cooling followed by shot blasting. This suggests that the presence of causes other than shot blasting cause surface defects (such as partial gloss variation and scabs).

Supplementary research was also conducted by us to discuss where surface defects occur most often on a slab. We have found that no surface defects occur at all on the upside of a slab. It is conjectured that surface defects occur in the course of either continuous casting or water cooling.

Investigations were carried out by us into how surface defects occur on cold-rolled steel sheets produced by hot rolling and cold rolling from continuously cast slabs which have been reversed prior to water cooling. Our results revealed that surface defects occur only on the underside of the reversed slab. A probable reason for this is that surface defects on steel sheets are due to water cooling.

The above-mentioned findings suggest that when slabs are cooled with water the underside is not cooled sufficiently or uniformly. Attempts were made to address this problem. A first one is intended to enhance and improve the cooling of the underside when slabs are cooled in water according to the process disclosed in Japanese Patent Laid-open No. 147468/1980. This process consists of dipping hot slabs in a coolant, while injecting a pressurized gas from below, toward the underside of the slab, thereby accomplishing cooling. This process is originally intended to decrease noise and warpage resulting from cooling. It was found in actual test work that this process is effective to some extent in decreasing noise and warpage but is not effective in preventing surface defects from being caused on cold-rolled steel sheets.

Detailed research was conducted on the relation between the surface state of slabs (after cooling) and the occurrence of dechromized layers, and also on the relation between the dechromized layers and the positions where surface defects occur on steel sheets produced from said slabs by hot rolling and cold rolling. We discovered that chromium carbide precipitates largely and dechromized layers develop in dents on slabs or deep oscillation marks and that surface defects occur on those parts of the steel sheet which correspond to dechromized layers.

The above-mentioned findings suggest that surface defects result from insufficient cooling due to incomplete heat conduction from slabs to water. This incomplete heat conduction occurs because steam bubbles and steam films (due to cooling) are held up in dents on slab surface or deep oscillation marks and they are not removed by the stirring action of pressurized gas being injected. There is even a case in which injected gas itself stays under the slabs to prevent heat conduction.

We have conceived the idea of injecting cooling water toward the undersides of slabs such that water flows in the cooling water vessel, thereby removing steam films and forcefully cooling the undersides of slabs.

One aspect of the present invention is an improved method for water-cooling slabs by dipping them in water, wherein said improvement comprises dipping each slab such that its larger faces are the upside and underside and injecting water toward the underside of each slab such that water flows. Water injection should preferably be carried out at a flow rate of 10–150 $L/M^2 \cdot min$ per unit area of the underside of the slab. Moreover, water injection should preferably be carried out perpendicularly or obliquely to the underside of the slab from a position 30–500 mm away from the underside of the slab.

In the case where the above-mentioned method is applied to continuously cast slabs containing Cr 5–30 wt % which are particularly subject to surface defects, it is desirable to heat them such that their surface temperature exceeds 500° C. and to cool them such that their surface temperature decreases below 400° C. by dipping them in water by the above-mentioned method. The duration of dipping in water should be such that when the Cr-containing slabs are pulled up from water and allowed to stand, the maximum temperature due to restored heat does not exceed 400° C. in the surface layer within 1% of the slab thickness.

Another aspect of the present invention is a method for reducing defects in Cr-containing slabs which comprises water-cooling Cr-containing slabs by the above-mentioned method, and subsequently performing blasting on said Cr-containing slabs whose warpage ratio is smaller than 3 mm/m which is defined by the amount of warp of the slab (mm) divided by the length of slab (m).

Another of the present invention is a cooling water vessel in which slabs are dipped for cooling, said vessel comprising slab supports which support slabs therein such that their larger faces are the upside and underside and a means to inject water toward the underside of the slab supported by said slab supports. The water injector should preferably be positioned perpendicularly or obliquely to the underside of the slab and 30–500 mm away from the underside of the slab.

The present invention is applied to slabs or blooms such as steel stocks to be fabricated into final products by rolling and forging. They may have a shape which permits steam films to dwell on the underside thereof. To be concrete, they may assume the shape of a flat rectangular parallelepiped. Although the present invention was motivated directly by defects in stainless steel which result from uneven precipitation of carbides and its concomitant dechromized layer in continuously cast stainless steel slabs, it can be applied to any kind of steel if quality defects occur when the underside of the slab is cooled in water unevenly or insufficiently. Needless to say, the present invention may be applied to slabs produced by pressure casting processes or slabs obtained from ingots by blooming.

The present invention requires that slabs be cooled by dipping in water. This way of cooling with a large amount of water is by far more effective than spray cooling. In addition, the present invention requires that slabs be dipped in water such that the larger faces of the slab are the upside and underside. The larger faces mean those faces which are the largest in surface area among the faces surrounding a slab. They are opposing two faces across the slab thickness. It is easily conjectured that it would be possible to prevent steam films from staying on the underside of a slab if a slab is dipped vertically in water. However, dipping slabs vertically in water needs an apparatus to stand up slabs (which leads to additional cost) because it is common practice to convey continuously cast slabs or rolled slabs almost horizontally, with their larger faces upside and underside.

Positioning slabs such that the larger faces of slabs are the upside and underside does not necessarily mean that the slab's larger faces are exactly perpendicular to the vertical direction. Holding slabs slightly aslant is rather desirable in order to efficiently wash out steam from the underside of the slab in view of the spirit of the present invention. However, the angle of inclination should be small enough for slabs to be handled conveniently by a crane or tongue.

What is most important in the present invention is that water should be injected toward the underside of the slab dipped in water in such a way that the water flows. Water injection is intended to wash away gas (steam) bubbles and films staying on or sticking to the underside of the slab by means of the momentum of injected water, thereby bringing about heat conduction through direct contact between the slab and the injected water and simultaneously increasing the coefficient of heat transfer due to turbulence.

It is particularly important to note that water cooling does not necessarily take place uniformly. That is, even in the case where cooling water is supplied at an average flow rate high enough for the slab surface to be kept at a temperature lower than 100° C., there exist those parts where water flow is slow locally due to surface irregularities on the slab. In these parts, the surface temperature of slabs exceeds 100° C., causing water to boil and generating steam bubbles.

It is important from this point of view that the amount of water to be injected should be large enough to do this and water should be injected from a position close to the underside of the slab. However, the cooling effect levels off when the amount of water to be injected exceeds a certain limit because the resistance of heat transfer within a slab becomes relatively larger than that between a slab and water (and hence cooling is limited by heat conduction and transfer within a slab).

The results of experiments with slabs of various size revealed that the amount of water for injection should preferably be 10–150 $L/m^2 \cdot min$ per unit area of the underside of the slab. If the water amount is less than specified above, uneven cooling would occur in continuously cast slabs having deep oscillation marks or in slabs lacking flatness in the larger faces. If the water amount is more than specified above, cost for pumps and pipes increases without additional cooling effect.

The direction of water injection may be parallel to the underside of the slab or perpendicular or oblique to the underside of the slab. However, the latter is desirable so as to bring about high turbulence on the underside of the slab, thereby achieving effective cooling and bubble removal.

The position of water injection should be adequately close to the underside of the slab so that the injected water does not decrease in speed before it reaches the underside of the slab. The greater the linear speed of water, the better the effect of washing away bubbles and cooling the slab. If the distance between them is too small, the pressure loss of water being injected increases because the injected water is thrown back from the underside of the slab. This greatly increases loads on the pump and pipe. As in the case of increasing the amount of cooling water, the effect produced by reducing the distance levels off because the resistance of heat transfer within a slab becomes relatively larger than that between a slab and water (and hence cooling is limited by heat conduction and transfer within a slab). With these factors taken into account, the distance between the position of water injection and the underside of the slab should preferably be 30–500 mm. With a distance smaller than 30 mm, the cooling effect levels off while loads on facilities increase uselessly. On the other hand, increasing the distance between the position of water injection and the underside of the slab decreases the flow rate of water reaching the underside of the slab and requires a deep water vessel (which leads to a high installation cost). With a distance greater than 500 mm, uneven cooling would occur in continuously cast slabs having deep oscillation marks or in slabs lacking flatness in the larger faces.

The above-mentioned cooling method is applied to Cr-containing slabs in the following manner. They are continuously cast slabs containing Cr 5–30 wt % which are subject to surface defects at the time of rolling into steel sheets. These surface defects arise from chromium carbides which precipitate during cooling. The present invention can be applied to slabs formed by continuous casting process of any type (including vertical type, vertical bent type, totally bent type, and horizontal type).

The present invention requires that the Cr-containing slabs should have a surface temperature higher than 500° C. prior to water cooling. Failure to meet this requirement permits chromium carbide precipitates to remain appreciably on the surface of slabs, and they lead to surface defects on rolled sheets even though water cooling is carried out according to the present invention. To meet this requirement the procedure explained below should be followed.

In continuous casting, molten steel is first poured into an open-ended mold with internal water cooling. With its outer layers solidified, the molten steel is continuously pulled out of the mold by a series of guide rolls, during which it is sprayed with cold water for complete solidification throughout. (This step is called secondary cooling.) The resulting continuous block of steel is cut into length by a flame an oxygen-gas mixture. (This step is called torch cutting.) The step of secondary cooling affects the surface temperature of slabs after torch cutting. In addition, natural cooling changes the surface temperature of slabs with time after torch cutting. Therefore, it is desirable to control the conditions of secondary cooling, the rate of casting, and the time lapse from torch cutting to water dipping, so that slabs have a surface temperature higher than 500° C. before water cooling.

Slabs with their surface temperature higher than 500° C. are then dipped in water and cooled until their surface temperature decreases below 400° C. by the cooling method specified in the present invention as mentioned above. Cooling by dipping in water rapidly lowers the high temperature (above 500° C. at which chromium carbide does not precipitate on the surface of slabs) to the low temperature (below 400° C. at which chromium carbide does not precipitate at grain boundaries). In this way it is possible to avoid the precipitation of chromium carbide at grain boundaries. This cooling may be carried out to such an extent that the temperature at the core of slabs decreases below 400° C. Such prolonged cooling, however, is detrimental to productivity.

For improved productivity, it is necessary to shorten the duration of water dipping. This can be achieved if the slabs are taken out of water midway through dipping and then subjected to post-treatment. A slab being cooled in water usually has a temperature profile such that the surface temperature is low and the inside temperature is high. When a slab having such a temperature profile is allowed to stand in the air, heat escapes spontaneously into the air and, at the same time, heat moves from the high-temperature inside to the low-temperature surface. As the result, the surface temperature rises until it reaches a peak, after which it lowers slowly. This is the phenomenon of heat restoration. In the case of Cr-containing slabs (Cr 5–30 wt %) which are taken out of water in the course of cooling, it is possible to avoid the precipitation of chromium carbides unless the peak temperature (due to heat restoration) exceeds 400° C.

Figure 6:
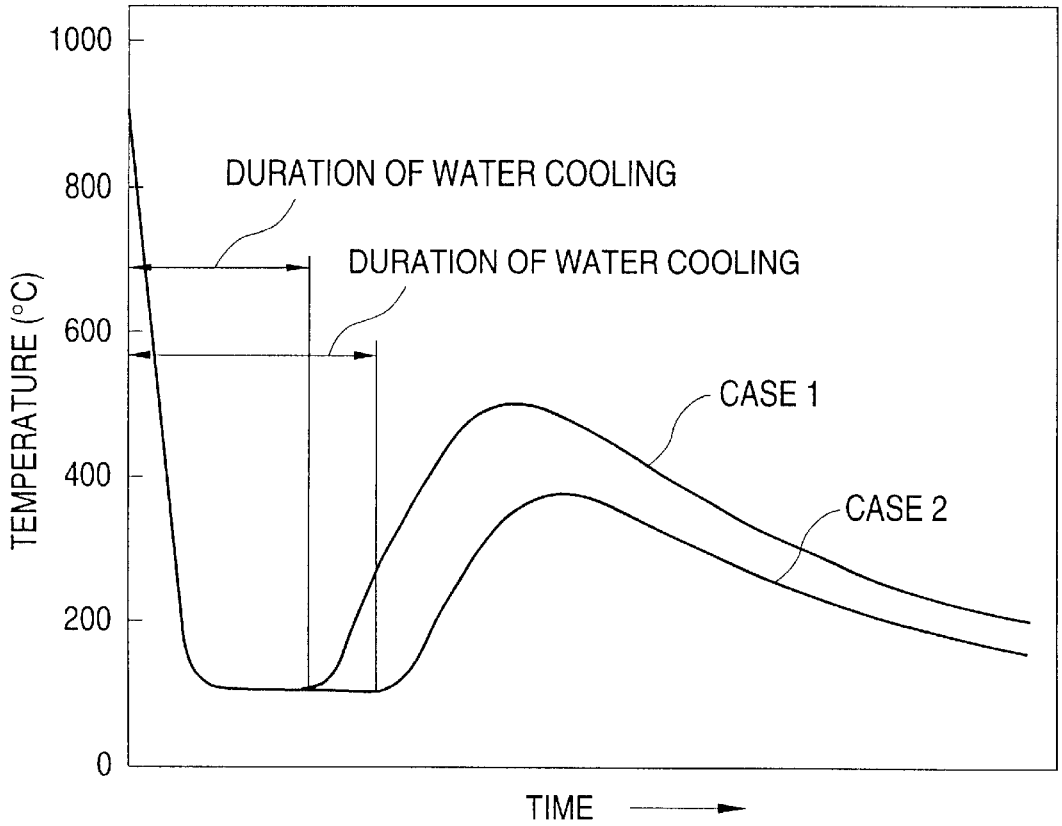
FIG. 6 is a graphical representation showing how a slab changes in surface temperature when it is dipped in water and pulled up from water in the course of cooling.

We have found that surface defects that occur in the rolled sheets produced from Cr-containing slabs result from precipitates or anomalous structures in the outermost layer (within 1% of the slab thickness). Therefore, we found that if it is possible to avoid precipitation of chromium carbides at least in this region, then it would also be possible to avoid the occurrence of surface defects due to precipitation of chromium carbides. Based on this idea, the present invention specifies the cooling procedure as follows. That is, the duration of water dipping for Cr-containing slabs (Cr 5–30 wt %) should be such that when the slabs are taken out of water and allowed to stand in the air, the maximum temperature due to heat restoration does not exceed 400° C. in the surface layer within 1% of the slab thickness. FIG. 6 schematically shows how the duration of water cooling affects the surface temperature of slabs due to heat restoration. Case 1 represents insufficient water cooling, which leads to a surface temperature (due to heat restoration) exceeding 400° C. Case 2 represents adequate water cooling, which leads to a surface temperature (due to heat restoration) lower than 400° C.

Figure 7:
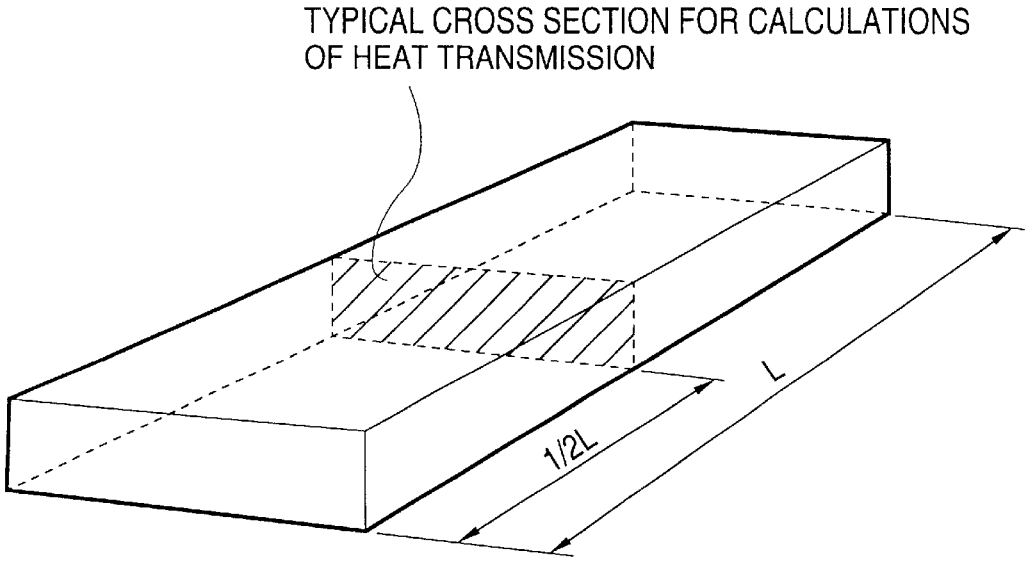
FIG. 7 is a schematic diagram showing the position of the typical cross section at which the temperature distribution due to heat conduction is calculated.

The temperature distribution in a slab cannot be obtained easily by actual measurement; however, it may be estimated by calculations of heat transmission. Three-dimensional calculations are ideal, but two-dimensional calculations are easy and practical which are performed on heat transmission along the typical cross section at the center in the lengthwise direction of the slab, as shown in FIG. 7. This is because the maximum temperature due to heat restoration appears at the center in the lengthwise direction of the slab, where there is almost no heat transmission in the lengthwise direction. In calculations, it is assumed for the initial condition that the slab before water dipping has an internal temperature equal to a surface temperature. The boundary condition for water dipping is derived from the coefficient of heat transfer due to forced convection which varies depending on the flow rate of water. For calculations of heat transmission after removal from water, the coefficient of heat transmission due to natural convection in the air is used. These numerical calculations permit one to estimate the temperature distribution in the slab that changes during and after water dipping. In this way it is possible to estimate the heat history in the surface layer within 1% of the slab thickness.

Those slabs which have been cooled by dipping in water for the prescribed length of time are immune to precipitation of chromium carbides under the surface layer. In other words, they are free from the dechromized phase responsible for surface defects. Consequently, such slabs yield steel sheets having very few surface defects. This is not the case if the slabs have non-metal inclusions trapped under their surface layer or have components segregated in troughs of oscillation marks.

To avoid these troubles, the present invention requires that the water-cooled Cr-containing slabs undergo blasting prior to heating for hot rolling. The best way to remove inclusions and segregation in the surface layer (which are responsible for surface defects) is to form a thick oxide scale in the heating stage prior to hot rolling and remove it together with inclusions etc. This procedure, however, is not applicable to Cr-containing steel which forms a dense chromium oxide film on the surface of the slab, thereby preventing the diffusion of oxygen and the sufficient development of scale.

We have found that it is possible to promote the diffusion of oxygen and the development of thick scale if the surface of the slab undergoes blasting which introduces minute strains. (See Japanese Patent Laid-open No. 98346/1993.) It is important that before introduction of such minute strains, the upside and underside of the slab should have the same amount of strain. If the upside and underside of the slab undergo cooling unevenly at the time of water dipping, they will differ in resistance to deformation and hence they will differ in the amount of strains to be introduced by blasting and also in the amount of descaling by blasting.

Figure 8:
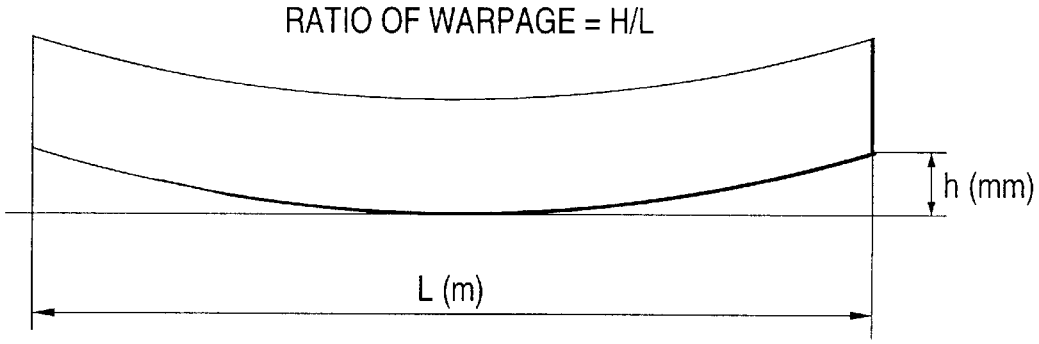
FIG. 8 is a diagram defining a ratio of warpage of a slab.

The present invention is designed to permit the upside and underside of a slab to cool evenly by injecting water toward the underside of a slab such that water flows when a slab is dipped in water for its cooling. Nevertheless, exactly even cooling does not take place. According to the present invention, how evenly the upside and underside of a slab are cooled is evaluated in terms of the ratio of warpage which is defined below as shown in FIG. 8.

Ratio of warpage (h/L)=[Amount of warp (h,mm)]/[Length of slab (L,m)]

We have found that if the ratio of slab warpage is smaller than 3 mm/m, then there is substantially no difference in the amount of strain to be introduced by blasting between the upside and underside of a slab. This leads to uniform descaling from the upside and underside of a slab in its heating or rolling process.

Incidentally, a preferred way of blasting is by shot blasting (by which a large number of spherical or odd-shaped hard particles are thrown at a high speed against an object to be treated), as disclosed in Japanese Patent Laid-open No. 98346/1993. Grit blasting is also acceptable (which is similar to shot blasting, with hard particles replaced by approximately spherical particles obtained by cutting a wire). Any hard particles will do regardless of their kind and shape.

According to the present invention, the cooling of slabs is carried out by using the cooling water vessel, which is explained below with reference to FIGS. 1 and 2. The cooling water vessel 1 is designed to cool slabs by dipping therein. It is comprised of a series of supports 2 and a series of water injectors 3. The supports 2 hold slabs horizontally. The water injectors 3 inject water toward the underside of slabs 4 held by the supports 2.

This cooling water vessel should preferably have an open top through which slab can come in and go out, as disclosed in Japanese Patent Laid-open No. 253807/1996 and 100609/1995. Such construction permits slabs to be dipped in water as they are delivered from the continuous casting facility or blooming mill without the necessity of changing their attitude. Except for this, the cooling water vessel is not specifically restricted in its configuration. For good productivity, the vessel should preferably be large enough to accommodate a plurality of slabs at one time.

Figure 4:
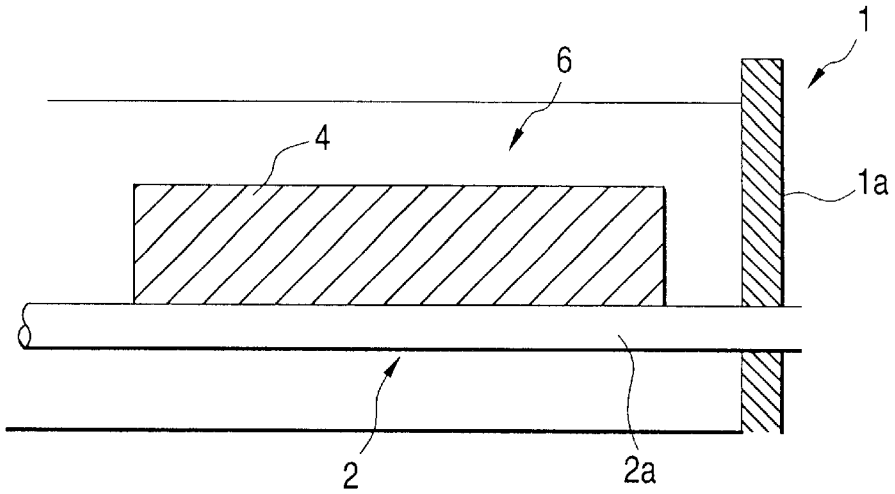
FIG. 4 is a schematic sectional view showing an example of slab supports in the cooling water vessel of the present invention.
Figure 5:
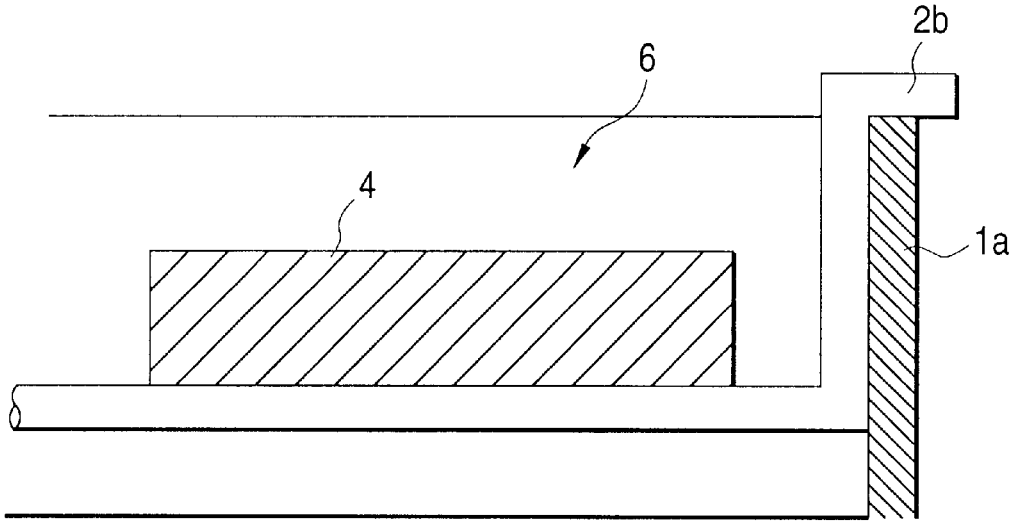
FIG. 5 is a schematic sectional view showing another example of slab supports in the cooling water vessel of the present invention.

The supports 2 are not specifically restricted in their structure so long as they support slabs 4 horizontally (with their larger faces being the upside and underside) and they support slabs 4 such that their underside is a certain distance away from the bottom of the vessel and there is a space for the water injector 3 to be installed therein and also there is a space for drainage (for injected water) to be installed therein. For example, the vessel 1 may be provided with rails at its bottom. Alternatively, the vessel 1 may have steel strips 2*d* welded to its bottom (as shown in FIG. 1) or may have protrusions on its bottom. Another way of supporting slabs is shown in FIGS. 4 and 5 (with the water injectors omitted). In FIG. 4, the support 2*a* is attached to the side wall 1*a* of the vessel. In FIG. 5, the support 2*b* is suspended from the upper end of the side wall la of the vessel. Many other modifications may be possible without departing from the spirit of the present invention.

The water injectors 3 are installed so as to inject water toward the underside of the slab 4 held by the slab support 2 in such a way that water flows. Examples of the water injector are shown in FIGS. 2 and 3. The water injector 3 is comprised of nozzles 3*a* (through which water is injected toward the underside of the slab 4), water feed pipes 3*b* (through which water is supplied to the nozzles 3*a*), and pipe supports 3*c* (to support the water feed pipes 3*b*). Cooling water supplied from the water feed pipe 3*b* is injected toward the underside of the slab 4. The injecting nozzle 3*a* is not specifically restricted in its construction. Preferred examples include submerged nozzles, slit-type nozzles (which inject water in flat form) simple openings in the wall of the feed water pipe, and openings in the side wall of the water vessel. Any other modifications are conceivable. The water feed pipe 3*b* is supported by the pipe support 3*c*.

The direction of water injection may be either parallel or perpendicular (or oblique) to the underside of the slab. The latter is preferable because of high cooling effect (due to turbulence) and bubble removing effect. Perpendicular injection is shown in FIG. 2, and oblique injection is shown in FIG. 3.

The position of water injection should preferably be 0–500 mm away from the underside of the slab for the reasons mentioned above. In the case of FIG. 3, the distance h should be measured along the neutral axis of water injection.

EXAMPLE 1

Figure 2:
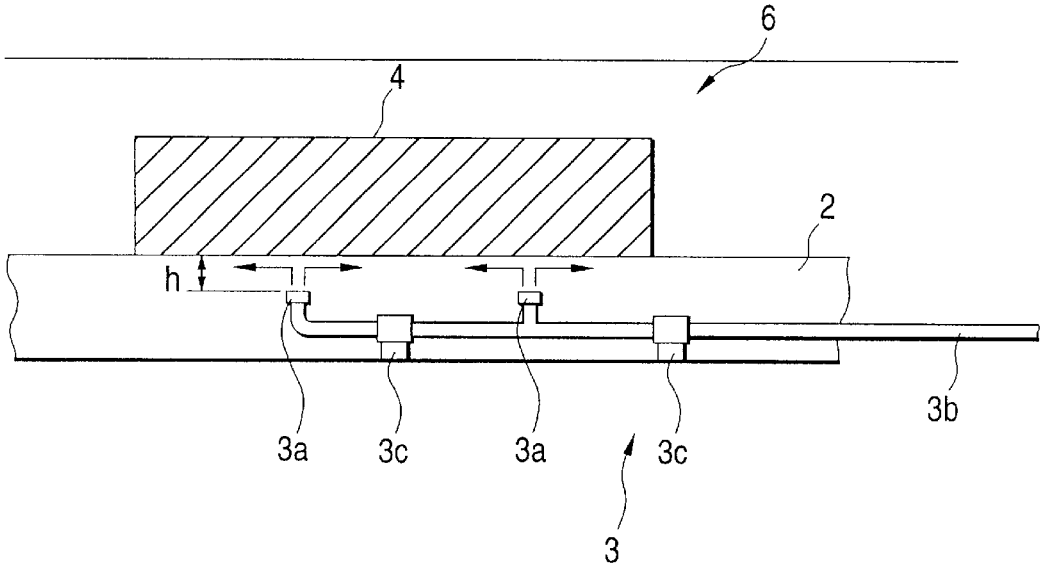
FIG. 2 is a schematic sectional view showing the construction of a water injector in the cooling water vessel pertaining to one example of the present invention.
Figure 3:
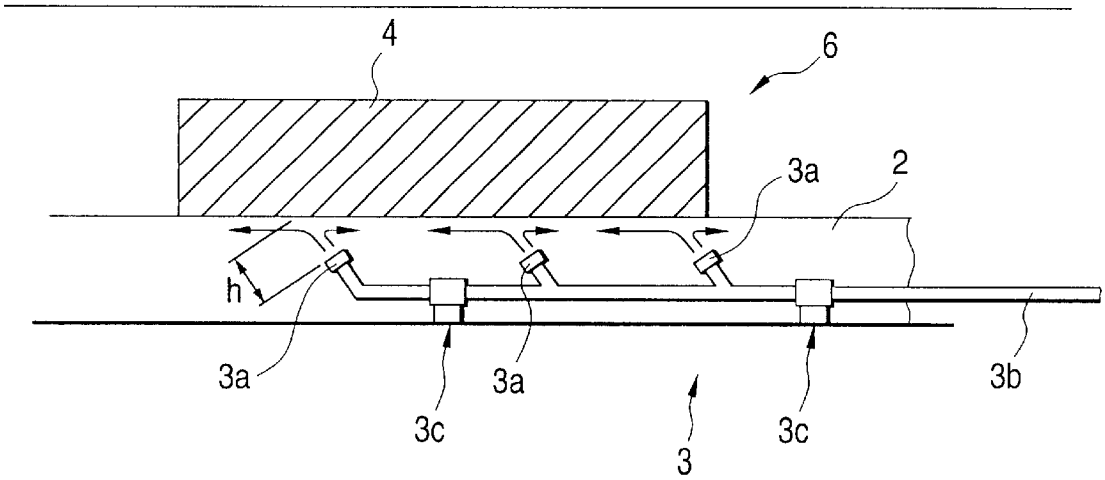
FIG. 3 is a schematic sectional view showing the construction of a water injector in the cooling water vessel pertaining to another example of the present invention.

This example demonstrates the effect of water cooling in a water cooling vessel (10 m long, 10 m wide, containing water 1.2 m deep) schematically shown in FIGS. 1 and 2. In this water cooling vessel were dipped ten SUS304 stainless steel slabs at one time which had just been continuously cast and torch-cut. Each slab measures 200 mm thick, 9.0 m long, and 650–1600 mm wide, and has a surface temperature of 850° C. The slabs were held such that their larger faces were approximately horizontal. During dipping, water was injected from the water injector 3 toward the underside of the slabs such that water flowed. The water injector 3 was 130 mm away from the underside of the slab, and the flow rate of injected water was 50 $L/m^2 \cdot min$. This water cooling vessel is large enough to accommodate a plurality of slabs in consideration of cooling time and productivity. Incidentally, the vessel has a plurality of slab supports 2 welded to its bottom. Each slab support is a narrow strip of 20 mm thick steel plate, positioned with its width upright. These slab supports keep the underside of the slabs 4 away from the bottom of the vessel.

The slabs were dipped in water until their central temperature decreases to 400° C. or below, and then pulled up from the vessel and heated in a slab heating furnace. The slabs underwent hot rolling and cold rolling to be made into 1.0 mm thick stainless steel sheet, which finally underwent finishing by bright annealing+final annealing or final annealing only. The thus obtained stainless steel sheet was examined for surface state. It was found to be free of scabs and uneven gloss on both sides thereof.

EXAMPLE 2

This example demonstrates the effect of water cooling by using the same cooling water vessel as in Example 1 (schematically shown in FIGS. 1 and 2) and SUS304 stainless steel slabs (200 mm thick, 9.0 m long, and 650–1600 mm wide, with a surface temperature of 850° C.) which had just been continuously cast and torch-cut. The slabs were dipped in water, with their larger faces held horizontal. After dipping for 20 minutes, the slabs were pulled up from water. Incidentally, water injection was carried out in the same way as in Example 1.

Calculations for two-dimensional heat transfer were carried out so as to predict the temperature change that would occur in the surface layer within 1% of the slab thickness after the slabs had been pulled up from water. It turned out that the duration of water dipping should be longer than 15 minutes if the maximum temperature due to heat restoration is to be 400° C. or below. In this example, therefore, dipping continued for 20 minutes.

After being pulled up from water, the ten slabs were heated in a heating furnace. They underwent hot rolling and cold rolling to be made into 1.0 mm thick stainless steel sheet, which finally underwent finishing by bright annealing+final annealing or final annealing only. The thus obtained stainless steel sheet was examined for surface state. It was found to be free of scabs and uneven gloss on both sides thereof.

EXAMPLE 3

Two stainless steel slabs were cooled in the same manner as in Example 2. They underwent hot rolling and cold rolling to be made into a 0.5 mm thick stainless steel sheet, which was finally underwent finishing by bright annealing+final annealing or final annealing only. The thus obtained stainless steel sheet was examined for surface state. It was found to be free of uneven gloss on both sides thereof; however, it was found to have scabs, with the ratio of surface defect being 0.2% (which is defined as [length of defective part in a coil] divided by [total length of coil] multiplied by 100%).

EXAMPLE 4

Two stainless steel slabs were cooled in the same manner as in Example 2. After cooling, they were found to have a warpage ratio of 0.2 mm/m. They underwent shot blasting on both the upside and underside thereof, with particles 1.5 mm in diameter and an initial velocity of 90 m/sec and a blasting density of 600 kg/m$^2$. The treated slabs were heated in a heating furnace and the heated slabs underwent hot rolling and cold rolling to be made into a 0.5 mm thick stainless steel sheet, which finally underwent finishing by bright annealing+final annealing or final annealing only. The thus obtained stainless steel sheet was examined for surface state. It was found to be free of scabs and uneven gloss.

COMPARATIVE EXAMPLE 1

The same procedure as in Example 1 was repeated except that water injection was replaced by compressed air injection (at 5 kgf/mm$^2$). The resulting stainless steel sheet was found to have no scabs and uneven gloss on the surface thereof which corresponds to the upside of the slab, whereas it was found to have scabs and uneven gloss on the surface thereof which corresponds to the underside of the slab. The ratio of surface defect (as defined above) was 1.8%.

COMPARATIVE EXAMPLE 2

The same procedure as in Example 1 was repeated except that water injection was omitted. The resulting stainless steel sheet was found to have no scabs and uneven gloss on the surface thereof which corresponds to the upside of the slab, whereas it was found to have scabs and uneven gloss on the surface thereof which corresponds to the underside of the slab. The ratio of surface defect (as defined above) was 2.0%.

Effect of the Invention:

As detailed above, the present invention is designed to cool sufficiently and evenly the underside of continuously cast stainless steel slabs during their dipping in water. The cooled slabs yield, after hot rolling and cold rolling, stainless steel sheet with a minimum of surface defects. The present invention is also applicable to steel slabs of any kind which would cause quality problems when their undersides are not cooled sufficiently or uniformly during dipping in water. Therefore, the present invention will greatly contribute to the industry.

What is claimed is:

1. A method for water-cooling a hot metallic slab having a temperature higher than 500° C., comprising: dipping the slabs in water under the surface thereof, wherein said slab has larger faces and smaller faces, and wherein said dipping is carried out with the larger faces of the slab arranged as the upside and underside thereof, and injecting liquid water by water injectors beneath the underside of the slab directed toward the underside but not the upside of the slab under the surface of said water in which said slab is dipped, in such a way as to inject liquid water flow on said underside of said slab at a flow rate sufficient to effectuate water cooling of said slab, wherein said cooling is performed in such a way as to avoid precipitation of carbides in said slab.

2. A method for water-cooling slabs as defined in claim 1, wherein the water injection is carried out at a flow rate of 10–150 L/m$^2$·min with respect to the underside of the slab.

3. A method for water-cooling a slab as defined in claim 1, wherein said water injection is carried out in a direction perpendicular to or oblique to said underside of said slab.

4. A method for water-cooling a slab as defined in claim 3, wherein location of the water injection is placed and liquid injection is carried out such that the position of release of said water injection is spaced 30–500 mm away from and beneath the underside of the slab.

5. A method for water-cooling a slab as defined in claim 1, wherein said slab comprises a continuously cast Cr-containing slab comprising Cr 5–30 wt % having a surface temperature of 500° C. or above, and wherein said dipping and injecting is continued until the surface temperature of said Cr-containing slab decreases to 400° C. or below.

6. A method for water-cooling a slab as defined in claim 5, wherein said dipping and injecting step lasts for such a period that when said slab is removed from said cooling water and allowed to stand in air, the maximum temperature due to heat restoration does not exceed 400° C. in the surface layer at a location positioned within 1% of the slab thickness.

7. A method for producing Cr-containing slabs to provide reduced defects, said method comprising water-cooling Cr-containing slabs by the method defined in claim 5 and performing blasting on said Cr-containing slabs which have a warpage ratio smaller than 3 mm/m, where the term warpage ratio means the amount of warp in said slab in millimeters divided by the length of said slab in meters.

* * * * *

UNITED STATES PATENT AND TRADEMARK OFFICE

CERTIFICATE OF CORRECTION

PATENT NO. : 6,250,370 B1
DATED : June 26, 2001
INVENTOR(S) : Chikashi Tada and Yuji Miki It is certified that error appears in the above-identified patent and that said Letters Patent is hereby corrected as shown below:

Claim 1,
Line 3, please change "slabs" to -- slab --.

Signed and Sealed this

Fifteenth Day of January, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,250,370 B1
DATED : June 26, 2001
INVENTOR(S) : Chikashi Tada and Yuji Miki It is certified that error appears in the above-identified patent and that said Letters Patent is hereby corrected as shown below:

Column 8,
Line 48, please change "0-500" to -- 30-500 --.

Signed and Sealed this

Fourteenth Day of May, 2002

*Attest:*

*Attesting Officer*

JAMES E. ROGAN
*Director of the United States Patent and Trademark Office*